US010450823B1

(12) United States Patent
Pruitt et al.

(10) Patent No.: US 10,450,823 B1
(45) Date of Patent: Oct. 22, 2019

(54) FLANGE ADAPTER

(71) Applicants: Grant Pruitt, Fort Smith, AR (US); Cris Braun, Van Buren, AR (US)

(72) Inventors: Grant Pruitt, Fort Smith, AR (US); Cris Braun, Van Buren, AR (US)

(73) Assignee: PRUITT TOOL & SUPPLY CO., Fort Smith, AR (US)

( * ) Notice: Subject to any disclaimer, the term of this patent is extended or adjusted under 35 U.S.C. 154(b) by 548 days.

(21) Appl. No.: 14/617,605

(22) Filed: Feb. 9, 2015

(51) Int. Cl.
*F16L 23/02* (2006.01)
*E21B 19/00* (2006.01)
*E21B 33/068* (2006.01)

(52) U.S. Cl.
CPC ..... *E21B 33/068* (2013.01); *E21B 19/00* (2013.01)

(58) Field of Classification Search
CPC ..... F16L 23/02; F16L 23/032; F16L 23/18; F16L 23/22; F16L 23/24; F16L 2201/10
USPC ..... 285/414, 412, 368, 148.22, 148.23, 285/148.25, 123.14, 123.13
See application file for complete search history.

(56) References Cited

U.S. PATENT DOCUMENTS 480,643 A * 8/1892 Welch ..... F16L 23/18 277/612
948,053 A * 2/1910 Horsley ..... F16L 23/12 122/DIG. 16
982,463 A * 1/1911 Bennett ..... F02M 61/168 285/148.23
1,215,451 A * 2/1917 White ..... F03B 11/02 285/148.22
1,796,159 A * 3/1931 Pallady ..... F16L 19/0218 285/272
2,176,359 A * 10/1939 Penick ..... E21B 33/04 285/123.14
2,178,700 A * 11/1939 Penick ..... E21B 33/04 166/78.1
2,493,556 A * 1/1950 Stone ..... E21B 19/10 175/423
2,974,684 A * 3/1961 Ginaven ..... B04B 7/085 138/141
3,324,534 A * 6/1967 Spurk ..... F16L 25/14 285/148.22
3,415,285 A * 12/1968 Torp ..... F16K 3/312 138/94.3
3,653,629 A * 4/1972 Keyston ..... E04G 13/02 249/19
3,845,975 A * 11/1974 Van Heijst ..... F16L 27/02 285/283
5,236,228 A * 8/1993 Lawton ..... F16L 23/02 285/148.25
5,318,098 A * 6/1994 Wagstaff ..... B22D 11/049 164/444

(Continued)

*Primary Examiner* — Aaron M Dunwoody
(74) *Attorney, Agent, or Firm* — Schrantz Law Firm, PLLC; Stephen D. Schrantz

(57) ABSTRACT

The flange adapter attaches to the flange of a housing such as a bowl. The flow line attaches at the flange of the housing. The flange adapter attaches at the flange of the bowl to enable attachment of flow lines of multiple sizes to the bowl. The flange adapter includes an attachment body that secures to the bowl and an attachment neck that is raised above the attachment body. The flange adapter provides a first set of attachment apertures for securing the flange adapter to the housing and a second set of attachment apertures for securing the flow line to the flange adapter.

20 Claims, 3 Drawing Sheets

(56) References Cited

U.S. PATENT DOCUMENTS 5,372,388 A * 12/1994 Gargiulo ..... F16L 39/00 285/110
5,437,482 A * 8/1995 Curtis ..... F16L 23/028 285/148.13
5,492,373 A * 2/1996 Smith ..... F16L 23/024 285/12
5,707,252 A * 1/1998 Meszaros ..... H01R 13/508 439/108
5,718,460 A * 2/1998 Glunt ..... F16L 55/00 138/44
6,209,927 B1 * 4/2001 Katra ..... F16F 15/06 285/225
6,447,028 B1 * 9/2002 LaMarca ..... F16L 25/08 285/123.13
6,568,712 B1 * 5/2003 Aaron, III ..... B23K 37/0533 285/24
8,534,713 B2 * 9/2013 Takeda ..... F16L 23/003 285/123.1
9,470,348 B1 * 10/2016 Bass ..... F16L 23/02
2001/0052703 A1 * 12/2001 Bos ..... F16L 23/032 285/412
2003/0062168 A1 * 4/2003 Yian Liew ..... E21B 33/047 166/313
2011/0074115 A1 * 3/2011 Cohen Zada Vaizman ..... F16J 15/181 277/513
2011/0204626 A1 * 8/2011 Degutis ..... F16L 47/14 285/415
2011/0304138 A1 * 12/2011 Commoner ..... E21B 43/0122 285/368
2012/0306198 A1 * 12/2012 McDonald Pinedo ..... F16L 23/032 285/323
2013/0168956 A1 * 7/2013 Sisk ..... F16L 41/021 285/126.1
2016/0200506 A1 * 7/2016 Sisk ..... B65D 90/623 251/145
2017/0146425 A1 * 5/2017 Strait ..... G01M 3/2853

* cited by examiner

FLANGE ADAPTER

CROSS-REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

RESERVATION OF RIGHTS

A portion of the disclosure of this patent document contains material which is subject to intellectual property rights such as but not limited to copyright, trademark, and/or trade dress protection. The owner has no objection to the facsimile reproduction by anyone of the patent document or the patent disclosure as it appears in the Patent and Trademark Office patent files or records but otherwise reserves all rights whatsoever.

BACKGROUND OF THE INVENTION

1. Field of the Invention

Oil, gas, water and geothermal wells are typically drilled with a drill bit connected to a hollow drill string which is inserted into a well casing cemented in the well bore. A drilling head is attached to the well casing, wellhead or to an associated blowout preventer to seal the interior of the well bore from the surface. The drilling head also facilitates forced circulation of drilling fluid through the well while drilling or diverting drilling fluids away from the well. Drilling fluids include, but are not limited to, water, steam, drilling muds, air, and other gases.

In well drilling, with a rotary drilling rig, the drill bit and drilling pipe receive rotary motion from power equipment located on the surface. Below the drilling floor, at the ground surface, an assembly known as a rotating head allows the circulation of various fluids used in the drilling.

The rotating head is often located within a housing, such as a bowl. The housing remains stationary during rotation of the rotating head. The housing provides a flange with at least one flow aperture from which fluids can flow from the bowl. The flow aperture enables fluids and other material into the housing and downhole. The flow aperture also enables fluids and other material to flow from downhole and out of the housing through the flow line. Allowing the fluids to flow from the bowl enables the system to maintain the pressure for underbalanced drilling. A flow line attaches to the flange to allow the fluids to flow from the bowl.

Different sized flow lines may be required based upon the drilling operation. However, the flange of the bowl is configured to operate with a specific size of flow line. Therefore, the bowls are specifically designed for one sized flow line to be attached to the bowl. If a different flow line is needed during a drilling operation, the drilling operators must install a different bowl sized for the necessary flow line. Multiple bowls will be required to be stored for usage at a drilling operation. If the appropriate bowl is not available, the drilling operation may be halted until the bowl is available.

Present day drilling operations are extremely expensive. An effort to increase the overall efficiency of the drilling operation while minimizing expense requires essentially continuous operation of the drilling rig. Thus, it is imperative that downtime be minimized and costs be reduced.

The present invention relates to a flange adapter attachable to the flange of the bowl to provide a secondary set of attachment apertures for securing the flow line to the bowl. The adapter enables the attachment of different sized flow lines to the bowl. Enabling attachment of different sized flow lines to the bowl increases the usability of the bowl and reduces the equipment needed at a drilling site. Such an adapter also decreases manufacturing costs as a universal bowl can be used at the drilling site. Because the bowl of the present invention can be secured with multiple sized flow lines, the present invention also reduces downtime while waiting for a bowl of the required sized. The present invention also reduces down time as the bowl can be fitted with the adapter instead of replacing the bowl if a different size is required.

II. Description of the Known Art

Patents and patent applications disclosing relevant information are disclosed below. These patents and patent applications are hereby expressly incorporated by reference in their entirety.

U.S. Pat. No. 4,511,193 (the '193 patent) issued to Geczy on Apr. 16, 1985 teaches a combined radial and thrust bearing assembly for a down-hole drilling assembly to journal a shaft, mounting the drill bit, in a housing. The bearing assembly is used between a down-hole fluid powered motor and a drill bit for drilling oil wells, for example. The bearing assembly includes cooperative pairs of upper and lower inner races located on the shaft for mutual rotation. Each of the inner races includes a pair of interchangeable toroidal tracks. Cooperative pairs of upper and lower outer races are fixed against rotation in the housing. Each outer race has a pair of interchangeable toroidal tracks to selectively cooperate with the tracks of the inner races to define a toroidal channel to receive a number of bearing balls. Spring means are disposed between the upper and lower pairs of outer races and the housing and between the upper and lower pairs of outer races to provide a compliant coupling for the even distribution of radial and upwardly and downwardly directed thrust loads between the races and balls and eventual transfer to the housing. Drilling fluid is circulated through the bearing assembly for cooling and lubrication.

U.S. Pat. No. 5,213,158 ("the '158 patent") issued to Bailey, et al. on May 25, 1993 teaches a drilling head with dual rotating stripper rubbers designed for high pressure drilling operations ensuring sealing under the extreme conditions of high flow or high pressure wells such as horizontal drilling. The dual stripper rubbers taught by the '158 patent seal on the same diameter yet are manufactured of different materials for different sealing functions. The lower stripper rubber is manufactured from a more rigid, abrasive resistant material to divert the flow from the well. The upper stripper rubber is manufactured of a softer sealing material that will closely conform to the outer diameter of the drill string thereby preventing the flow of fluids through the drilling head.

U.S. Pat. No. 5,647,444 issued to Williams on Jul. 15, 1997 ("the '444 patent") discloses a rotating blowout preventor having at least two rotating stripper rubber seals which provide a continuous seal about a drilling string having drilling string components of varying diameter. A stationary bowl taught by the '444 patent is designed to support a blowout preventor bearing assembly and receives a swivel ball that cooperates with the bowl to self-align the blowout preventor bearing assembly and the swivel ball with respect to the fixed bowl. Chilled water taught by the '444 patent is circulated through the seal boxes of the blowout preventor bearing assembly and liquid such as water is pumped into the bearing assembly annulus between the stripper rubbers to offset well pressure on the stripper rubbers.

U.S. Pat. No. 3,868,832 issued to Biffle on Mar. 4, 1975 ("the '832 patent") teaches a rotary drilling head assembly for wellbore forming operations comprising a stationary housing which supports a rotatable sleeve. A stripper rubber located within the rotatable sleeve taught by the '832 patent slidably receives a tubing string in sealed relationship therethrough.

SUMMARY OF THE INVENTION

The flange adapter of the present invention attaches to the flange of a housing such as a bowl. The bowl attaches to a flow line to allow fluids to flow into and/or out of the housing. A flow aperture of the bowl provides access into the interior of the housing from the side of the housing. The flow aperture may serve as an outlet. The flow aperture enables fluids and other materials to flow from downhole into the housing and through the flow line. The flow line attaches at the flange of the housing. The flanges of the known art allow only one given size of flow line to attach at the flange.

The flange adapter of the present invention enables attachment of flow lines of multiple sizes to the bowl. The flange adapter includes an attachment body that secures to the bowl. The attachment body provides a base for securing the flange adapter to the housing. The flange adapter also provides an attachment neck that provides a raised surface located forward of the attachment body. The attachment neck is located interior of the outer edge of the attachment body.

The flange adapter provides at least two types of attachment apertures. A base aperture located on the attachment body is placed a first distance away from a flow aperture of the flange adapter. A neck aperture located on the attachment neck is placed a second distance away from the flow aperture of the flange adapter. The neck aperture is located closer to the flow aperture than the base aperture.

The known art provides a bowl with a flange that secures only a single size flow line. The known art does not allow the attachment of different sized flow lines to the flange. To attach flow lines of different diameters, the drilling operation requires installing a separate bowl for attachment of different sized flow line. If the drilling team requires a flow line of a different diameter, drilling must cease while the drilling team installs the appropriate bowl. If the appropriate sized bowl is not available, drilling operations may cease until the appropriate equipment is available. The present invention provides an adapter to allow a bowl to attach to flow lines of multiple diameters.

It is an object of the present invention to provide a flange adapter to enable attachment of different sized flow lines to the housing.

It is another object of the present invention to reduce the amount of equipment required at the drilling site.

It is another object of the present invention to increase the functionality of the bowl.

Another object of the present invention is to allow attachment of flow lines of multiple sizes to the bowl.

Another object of the present invention is to reduce downtime of a drilling operation.

Another object of the present invention is to create a safer work environment for rig personnel.

Another object of the present invention is to simplify the method of attaching and removing a flow line to the bowl.

Another object of the present invention is to eliminate the need for different sized bowls.

It is another object of the present invention to reduce manufacturing costs of the bowl.

It is another object of the present invention to reduce transportation costs associated with transporting the bowls to the drilling site.

In addition to the features and advantages of the flange adapter according to the present invention, further advantages thereof will be apparent from the following description in conjunction with the appended drawings.

These and other objects of the invention will become more fully apparent as the description proceeds in the following specification and the attached drawings. These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

Figure 1:
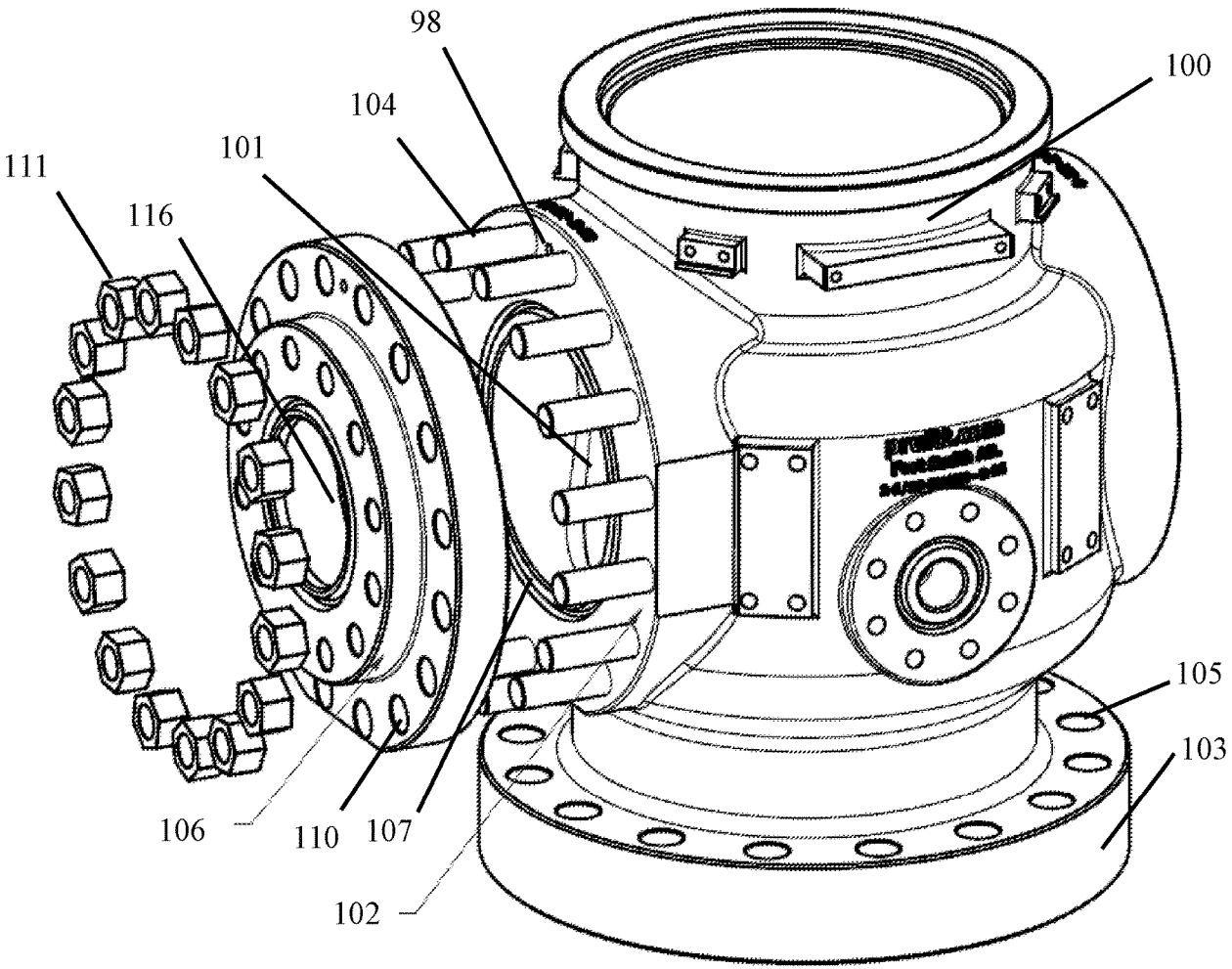
FIG. 1 is an environmental view showing one embodiment of the present invention.
Figure 3:
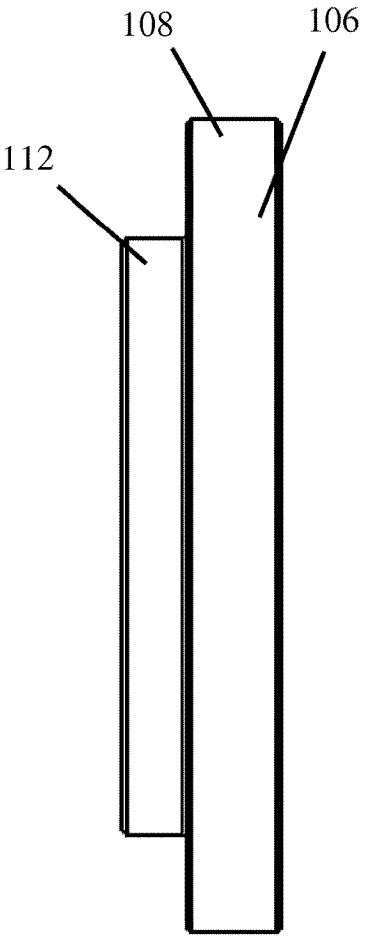
FIG. 3 is a right side view thereof, the left side view being a mirror image of the right side view.

Referring to FIG. 1, the flange adapter 106 of the present invention attaches to the flange 102 of a housing 100 such as a bowl. The bowl attaches to a flow line to allow fluids and other materials to flow into and out of the housing 100. A flow aperture 101 of the bowl provides access into the interior of the housing 100 and downhole from the side of the housing 100.

The flow aperture 101 may serve as an outlet. The flow aperture 101, as an outlet, enables fluids and other materials to flow from downhole into the housing 100 and through the flow line. The flow line attaches at the flange 102 of the housing 100. The flanges 102 of the known art allow only one given size of flow line to attach at the flange.

The housing 100 allows attachment of the flow line at flange 102 via attachment fingers 104, such as a housing fastener secured to the housing. In one embodiment, the attachment fingers 104 are screws, set screws, bolts, or other fasteners. The flow line seals against the housing 100 to allow fluids and other materials to flow either into or out of the housing 100. Connecting the flow line directly via attachment fingers 104 secures a single sized flow line for which the housing is designed to attach. However, flow lines are available in multiple sizes, such as 11-3M, 7-5M, and 9-3M.

The flange adapter 106 enables attachment of different sized flow lines to the housing 100. Flange adapter 106 attaches to the housing 100 and provides a secondary attachment surface capable of securing a different sized flow line to the flange adapter 106 and the housing 100. Similar to the flange 102, the flange adapter 106 provides an area for attachment of a flow line. However, the flange adapter 106 provides a secondary set of attachment apertures arranged in a configuration different from the attachment arms 104 and base apertures 110.

In most embodiments, the flow line secured to the flange adapter 106 is smaller in diameter than the flow line attachable to flange 102. The base apertures 110 are arranged in a configuration similar to the configuration of the flow line for which the housing is designed to attach. The base apertures 110 of one embodiment are arranged at a first distance from the flow aperture 116. The neck apertures 114 of one embodiment are arranged at a second distance from the flow aperture 116. In this embodiment, the first distance is greater than the second distance. Thus, the base apertures 110 are located exterior of the neck apertures 114. Such an arrangement of attachment apertures 110, 114 enables the flange adapter 106 to secure a flow line of a smaller size to the housing 100. For an embodiment securing a larger flow line, the neck apertures 114 will be spaced at a greater distance from the adapter flow aperture 116 than the distance from the base apertures 110 to the adapter flow aperture 116.

Continuing to refer to FIG. 1, the flange adapter 106 secures to the housing 100. The base of the attachment body 108 provides a surface for securing the flange adapter 106 to the housing 100. Two types of attachment apertures 110, 114 are located on the flange adapter 106. Base apertures 110 secure the flange adapter 106 to the housing 100. Neck apertures 114 secure the flow line to the flange adapter 106.

The flange adapter 106 attaches to the housing 100 via attachment arms 104 placed into base apertures 110. A locking body 111, such as a nut, secures the flange adapter 106 onto the attachment arms 104. The flange adapter 106 attached to the housing 100 provides a second set of attachment apertures, neck apertures 114, for securing the flow line to the flange adapter 106 and the housing 100.

Figure 2:
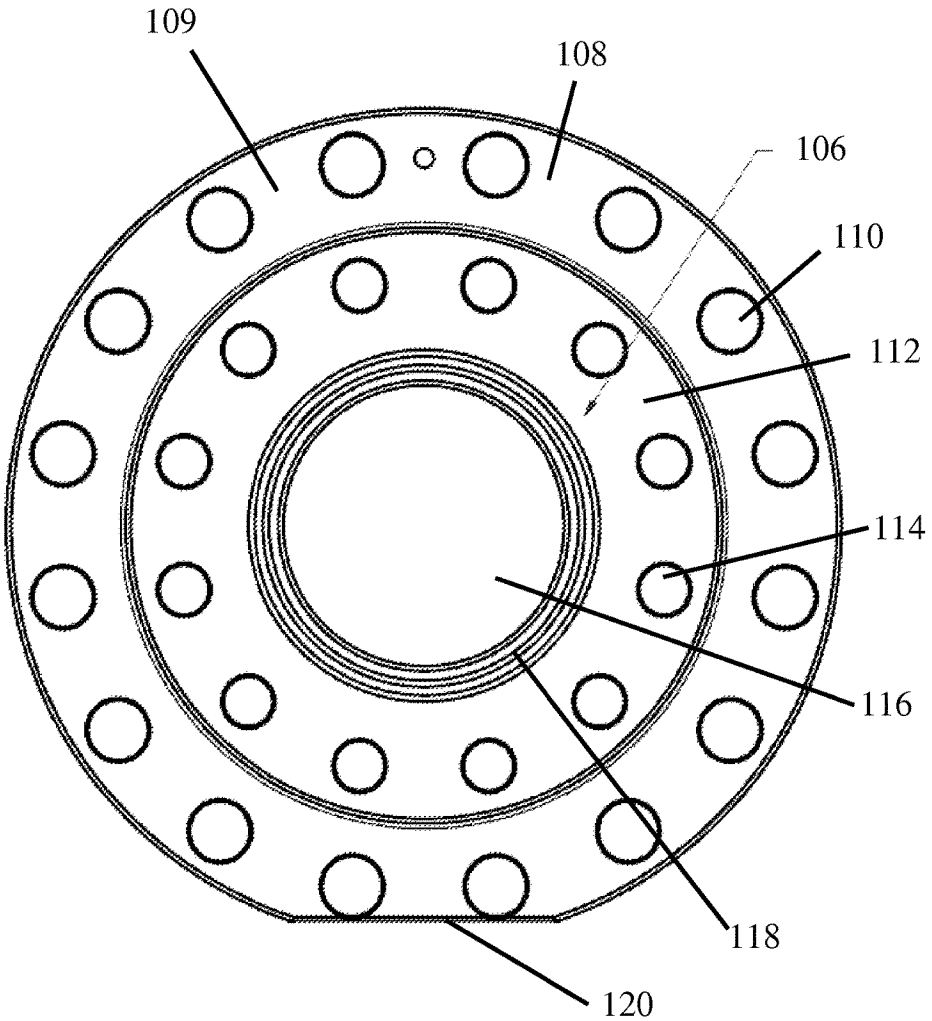
FIG. 2 is a front view of one embodiment of the present invention.
Figure 4:
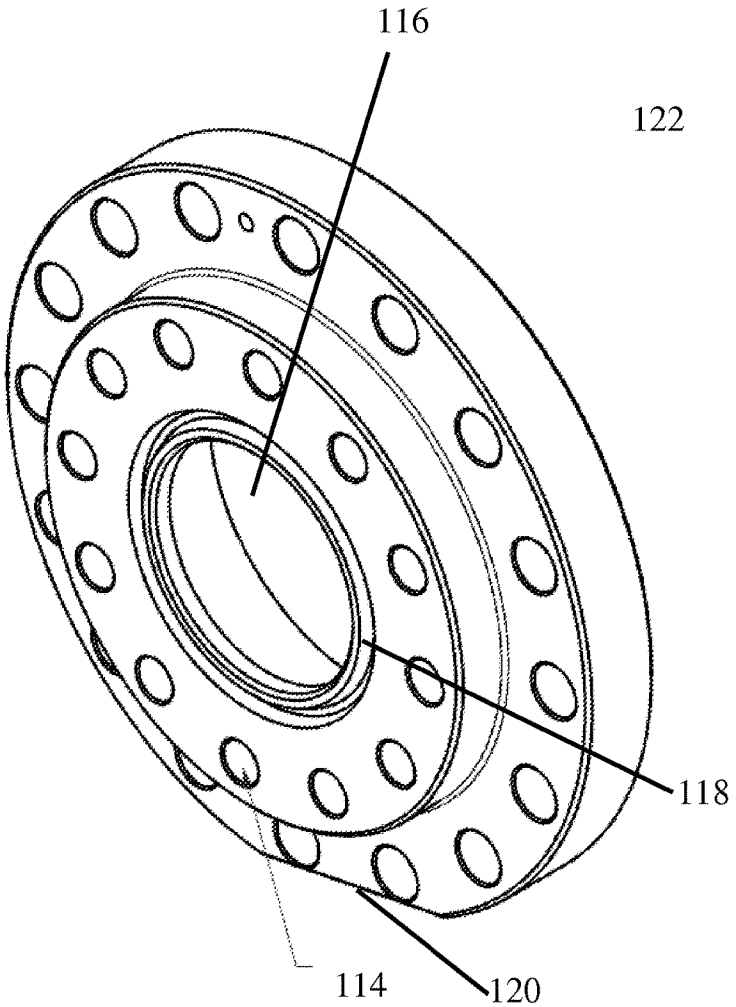
FIG. 4 is a front perspective view thereof.

Referring to FIG. 2, flange adapter 106 provides an attachment body 108 that secures to the bowl and an attachment neck 112 that extends outward from the attachment body 108. The attachment neck 112 is located interior of the outer edge of the attachment body 108 and a shorter distance away from adapter flow aperture 116 than the distance of the adapter flow aperture 116 to the base apertures 110. The attachment neck 112 of one embodiment is raised from the front surface 109 of the attachment body 108 such that the attachment neck 112 is not flush with the attachment body 108 as shown in FIG. 4. The attachment neck extends outward from the front surface 109 of the attachment body 108 away from the rear surface 122 of the flange adapter 106.

At least one base aperture 110 located on the attachment body 108 is placed a first distance away from a flow aperture 116 of the flange adapter 106. The base aperture 110 enables attachment of the flange adapter 106 to the housing 100 via attachment fingers 104 and locking body 111 as discussed above. Attachment finger 104 inserts into the base aperture 110. Locking body 111 is then secured onto attachment finger 104 to secure flange adapter to housing 100 adjacent flange 102.

Neck aperture 114 provides an attachment point for attaching the flow line. Neck aperture 114 located on the attachment neck 112 is located a second distance away from the flow aperture 116 of the flange adapter 106. The neck aperture 114 is located closer to the flow aperture 116 than the base aperture 110. Such an arrangement of neck aperture 114 and base aperture 100 enables attachment of a smaller flow line to the housing 100.

Instead of the smaller flow line attaching directly to the housing, the smaller flow line attaches to flange adapter 106 secured to the housing 100. The neck apertures 114 provide a smaller pattern for attachment of the smaller flow line than the pattern of the base apertures 110 and attachment fingers 104. The neck apertures 114 accept a fastener, including but not limited to a bolt, to secure the flow line to the flange adapter.

In one embodiment, the attachment apertures 110, 114 are arranged in a circular pattern. The configuration of base apertures 110 may be arranged with a first radius from the center of the adapter flow aperture 116. The configuration of neck apertures 114 may be arranged with a second radius from the center of the adapter flow aperture 116. The flow aperture 116 may also be formed in a circular pattern. The adapter flow aperture 116 is located within the configuration of neck apertures 114 and base apertures 110. The neck apertures 114 are located within the configuration of base apertures 110.

The base apertures 110 of one embodiment are arranged at a first distance from center of the adapter flow aperture 116. The neck apertures 114 of one embodiment are arranged at a second distance from the center of the adapter flow aperture 116. As shown in FIG. 2, the first distance is greater than the second distance. Thus, the base apertures 110 are located exterior of the neck apertures 114.

Referring to FIGS. 2 and 4, a seal inserts into seal base 118 for sealing the connection between the flow line and flange adapter 106. The seal base 118 is located adjacent flow aperture 116. Sealing the connection of the flange adapter 106 with the flow line reduces and/or eliminates fluid and other materials from leaking from the connection. The seal provides a safer environment for workers who are operating the drill site.

Figure 5:
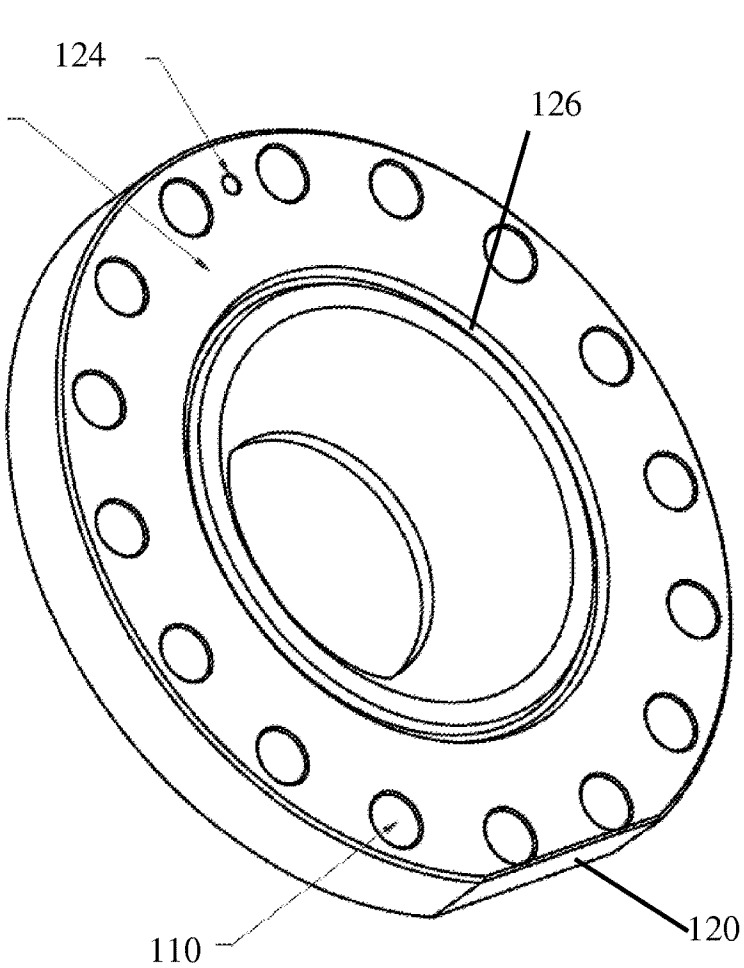
FIG. 5 is a rear perspective view thereof.

FIGS. 2 and 4-5 also show the flattened bottom 120 of flange adapter 106. The flattened bottom 120 matches the shape of flange 102. The flattened bottom 120 provides increased space above the base 103 of housing. The increased space simplifies the process of removing fasteners from apertures 105 for securing the housing 100.

FIG. 5 shows the seal base 126 for placement of a seal to seal the connection between the flange adapter 106 and housing 100 at flange 102. The seal base 126 is located adjacent flow aperture 116. Sealing the connection of the flange adapter 106 with the flange 102 reduces and/or eliminates fluid and other materials from leaking from the connection. The seal provides a safer environment for workers who are operating the drill site.

In one embodiment, the adapter flow aperture 116 is larger at the rear surface 122 of the flange adapter 106 than the front surface 109 of the flange adapter 106. The size of the opening at adapter flow aperture 116 increases from the front surface 109 towards the rear surface 122 of flange adapter 106. The increase sized of adapter flow aperture 116 aligns seal base 126 at the rear surface 122 of flange adapter 106 with housing seal base 107 of housing 100. The adapter flow aperture 116 of one embodiment has a larger diameter at the rear surface 122 of the flange adapter 106 than the front surface 109 of the flange adapter 106. In another embodiment, the flow aperture 116 is the same size at the front surface of the flange adapter 106 as the rear surface 122 of the flange adapter 106. Aligning the seal bases 107, 126 improves the seating of the seal to reduce and/or eliminate fluids from leaking from the housing 100.

In one embodiment, the housing 100 and the flange adapter 106 provide alignment apertures 98, 124. The user can align the alignment aperture 98 of the housing 100 with the alignment aperture 124 of the flange adapter 106 for securing the flange adapter 106 with the attachment arms 104 secured to housing 100. The alignment apertures 98, 124 assist the user with aligning the proper base aperture 110 with the proper attachment arm 104. Such alignment places the flattened bottom 120 of the flange adapter 106 in the proper position.

Continuing to refer to FIG. 5, the base apertures 110 extend to the rear surface 122 of the flange adapter 106. The base apertures 110 pass completely through the attachment body 108 to allow the attachment fingers 104 to pass through the flange adapter 106 to secure the flange adapter 106 to housing 100. The neck apertures 114 of one embodiment do not extend to the rear 122 of the flange adapter 106. The neck apertures of such an embodiment do not completely pass through the flange adapter 106. In another embodiment, the neck apertures 114 extend to the rear of the flange adapter 106 such that the neck apertures 114 pass through the flange adapter 106.

The flange adapter 106 of one embodiment attaches to the outlet of the housing. When attached to the outlet, fluids and/or other materials from downhole flow from downhole up to the housing, out the outlet, and through the flange adapter 106 and the flow line. In such an embodiment, the materials being drilled for travel up and through the flow line.

The flange adapter 106 of one embodiment may also attach to the inlet of the housing. When attached to the inlet, fluids and/or other materials are pumped downhole through the flow line into the flange adapter and housing and downhole.

From the foregoing, it will be seen that the present invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A flange adapter apparatus for attachment to a housing at a flange of the housing wherein the apparatus secures a flow line to the housing at a housing flow aperture to allow fluids to travel through the housing and horizontally through the flow line, wherein the flange adapter aligns with a housing alignment indicator for proper orientation of the apparatus when secured to the housing, the apparatus comprising:

an attachment body attachable to the housing near the housing flow aperture;

a first attachment aperture located on the attachment body, the first attachment aperture configured to accept a fastener to secure the attachment body to the housing;

a second attachment aperture located on the flange adapter wherein the second attachment aperture is located laterally interior of the first attachment aperture, the second attachment aperture configured to accept a fastener to secure the flow line to the flange adapter;

an adapter flow aperture of the flange adapter, the adapter flow aperture located interior of the first attachment aperture and the second attachment aperture, wherein the fluids travel horizontally through the adapter flow aperture from the housing to the flowline;

an outer edge of the attachment body encompassing the adapter flow aperture to direct all fluid passing through the flange adapter through the adapter flow aperture;

a flattened section of the outer edge defined by the outer edge of the attachment body;

a curved section of the outer edge defined by the outer edge of the attachment body wherein the curved section is located radially outward from the adapter flow aperture wherein the flattened section is located nearer the adapter flow aperture than the curved section;

a rear surface of the attachment body wherein the rear surface is located adjacent the housing when the flange adapter attaches to the housing;

a first seal base encompassing the adapter flow aperture on the rear surface of the attachment body, wherein the first seal base accepts a seal;

a housing seal base on the housing wherein the attachment of the attachment body to the housing aligns the first seal base with the housing seal base; and an adapter alignment indicator located on the attachment body, the adapter alignment indicator distinct from the first attachment aperture and the second attachment aperture wherein alignment of the adapter alignment indicator with the housing alignment indicator orients the flattened section of the attachment body to be installed as a lowest surface of the attachment body secured to the housing for the fluids to flow horizontally through the adapter flow aperture to the flowline.

2. The apparatus of claim 1 further comprising:

a front surface of the attachment body located opposite of the rear surface; and an attachment neck located interior of the first attachment aperture wherein the attachment neck is raised from the front surface of the attachment body wherein the attachment neck abuts the front surface of the attachment body, the adapter alignment indicator located laterally outward from the attachment neck.

3. The apparatus of claim 2 further comprising:

a front surface of the flange adapter located opposite of the rear surface wherein the first attachment aperture and the second attachment aperture penetrate the front surface;

wherein the first attachment aperture penetrates both the front surface and the rear surface of the attachment body; and the second attachment aperture terminates before reaching the rear surface.

4. The apparatus of claim 3 further comprising:

a housing fastener that at least partially passes through the first attachment aperture;

a locking body that secures to the housing fastener wherein the attachment body is located between the locking body and the housing for securing the attachment body to the housing.

5. The apparatus of claim 4 wherein the second attachment aperture accepts a fastener to secure the flow line to the flange adapter.

6. The apparatus of claim 3 further comprising:

a second seal base encompassing the adapter flow aperture on the attachment neck of the front surface of the attachment body, wherein the second seal base accepts a seal, the second seal base sized smaller than the first seal base;

the first seal base located adjacent the adapter flow aperture; and the second seal base located adjacent the adapter flow aperture.

7. The apparatus of claim 2 wherein the first attachment aperture is located on the attachment body wherein the first attachment aperture is located a first distance from the center of the adapter flow aperture; and the second attachment aperture is located on the attachment neck wherein the second attachment aperture is located a second distance from the center of the adapter flow aperture wherein the second distance is less than the first distance;

wherein the first seal base is located radially inward from the first set of attachment apertures and the first seal base is located radially outward from the second set of attachment apertures such that the first seal base is located radially between the first set of attachment apertures and the second set of attachment apertures.

8. The apparatus of claim 1 wherein the adapter alignment indicator is located laterally outward from the second attachment aperture.

9. The apparatus of claim 1 wherein the first attachment aperture is located a first distance from the adapter flow aperture;

the second attachment aperture is located a second distance from the adapter flow aperture wherein the second distance is less than the first distance.

10. The apparatus of claim 1 wherein an outer edge of the attachment body forms a truncated circle forming the flattened section.

11. The apparatus of claim 1 wherein the flange adapter encompasses the adapter flow aperture to prevent the fluid from flowing laterally exterior of an outer edge of the flange adapter.

12. A flange adapter apparatus for attachment to a bowl at a flange of the bowl wherein the apparatus secures a flow line to the bowl at a housing flow aperture to allow fluids to travel through the bowl and horizontally through the flow line, wherein the flange adapter aligns with a bowl alignment indicator for proper orientation of the apparatus when secured to the bowl, the apparatus comprising:

an attachment body attachable to the bowl near the housing flow aperture;

a first set of attachment apertures comprising at least two attachment apertures wherein the first set of attachment apertures are located on the attachment body, the attachment apertures of the first set of attachment apertures accept a fastener to secure the attachment body to the bowl;

a second set of attachment apertures comprising at least two attachment apertures wherein the second set of attachment apertures are located interior of the first set of attachment apertures, the attachment apertures of the second set of attachment apertures accept a fastener to secure the flow line to the flange adapter;

an adapter flow aperture of the flange adapter, the adapter flow aperture located interior of the first set of attachment apertures and the second set of attachment apertures wherein the adapter flow aperture defines a longitudinal axis, wherein the fluids travel horizontally through the adapter flow aperture from the bowl to the flowline;

an outer edge of the attachment body that encompasses the adapter flow aperture wherein the outer edge extends radially outward a first distance from the adapter flow aperture;

a flattened section of the outer edge wherein the flattened section is located less than the first distance from the adapter flow aperture;

a curved section of the outer edge defined by the outer edge of the attachment body wherein the curved section is located radially outward from the adapter flow aperture;

a rear surface of the attachment body wherein the rear surface is located adjacent the bowl when the flange adapter attaches to the bowl;

a front surface of the attachment body located opposite of the rear surface; and an attachment neck located radially inward of the first set of attachment apertures wherein the attachment neck is raised from the front surface of the attachment body, the second set of attachment apertures located on the attachment neck wherein the attachment neck extends longitudinally outward from the front surface of the attachment body;

a first seal base encompassing the adapter flow aperture on the rear surface of the attachment body, wherein the first seal base accepts a seal;

said housing flow aperture extending longitudinally into the bowl;

a housing seal base on the bowl located adjacent the housing flow aperture wherein the attachment of the attachment body to the bowl aligns the first seal base with the housing seal base; and an adapter alignment indicator located on the attachment body, the adapter alignment indicator distinct from the first set of attachment apertures and the second set of attachment apertures, the adapter alignment indicator located radially outward from the attachment neck, wherein alignment of the adapter alignment indicator with the bowl alignment indicator orients the flattened section of the attachment body to be installed as a lowest surface of the attachment body secured to the bowl for the fluids to flow horizontally through the adapter flow aperture to the flowline.

13. The apparatus of claim 12 wherein the first set of attachment apertures are located a first distance from the adapter flow aperture;

the second set of attachment apertures are located a second distance from the adapter flow aperture wherein the second distance is less than the first distance;

wherein the first seal base is located radially inward from the first set of attachment apertures and the seal base is located radially outward from the second set of attachment apertures such that the first seal base is located radially between the first distance from the adapter flow aperture and the second distance from the adapter flow aperture wherein the first seal base is located radially between the first set of attachment apertures and the second set of attachment apertures.

14. The apparatus of claim 12 further comprising:

wherein a diameter of the adapter flow aperture is sized larger on the rear surface than the diameter of the adapter flow aperture on the front surface;

wherein the first set of attachment apertures penetrate both the front surface and the rear surface of the attachment body; and the second set of attachment apertures terminate before reaching the rear surface.

15. The apparatus of claim 14 further comprising:

a housing fastener that at least partially passes through one of the attachment apertures of the first set of attachment apertures;

a locking body that secures to the housing fastener wherein the attachment body is located between the locking body and the bowl to secure the attachment body to the bowl;

wherein one of the attachment apertures of the second set of attachment apertures accepts a fastener to secure the flow line to the flange adapter.

16. The apparatus of claim 14 further comprising:

a second seal base encompassing the adapter flow aperture on the front surface of the attachment body, wherein the second seal base accepts a seal wherein the first seal base has a larger radius than the second seal base;

the first seal base located adjacent the adapter flow aperture; and the second seal base located adjacent the adapter flow aperture.

17. The apparatus of claim 12 wherein the outer edge of the attachment body forms a truncated circle;

wherein misalignment of the adapter alignment indicator orients a curved outer edge to contact a flange of the bowl.

18. A flange adapter apparatus for attachment to a bowl at a flange of the bowl wherein the apparatus secures a flow line to the bowl at a housing flow aperture to allow fluids to travel through the bowl and horizontally through the flow line, wherein the flange adapter aligns with a bowl alignment indicator for proper orientation of the apparatus when secured to the bowl, the apparatus comprising:

an attachment body attachable to the bowl near the housing flow aperture;

a first set of attachment apertures comprising at least two attachment apertures wherein the first set of attachment apertures are located on the attachment body, the attachment apertures of the first set of attachment apertures accept a fastener to secure the attachment body to the bowl;

a second set of attachment apertures comprising at least two attachment apertures wherein the second set of attachment apertures are located on the flange adapter interior of the first attachment aperture, the attachment apertures of the second set of attachment apertures accept a fastener to secure the flow line to the flange adapter;

an adapter flow aperture of the flange adapter wherein the adapter flow aperture defines a longitudinal axis, the adapter flow aperture located interior of the first set of attachment apertures and the second set of attachment apertures, wherein the fluids travel horizontally through the adapter flow aperture from the bowl to the flowline;

the first set of attachment apertures located a first distance from the adapter flow aperture;

the second set of attachment apertures located a second distance from the adapter flow aperture wherein the first distance is greater than the second distance;

an outer edge of the attachment body that encompasses the adapter flow aperture wherein the outer edge provides a curved outer edge for a majority of the attachment body, the curved outer edge located a first distance from the adapter flow aperture;

a flattened section of the outer edge wherein the flattened section provides a flat surface adjacent the curved outer edge wherein the flattened section is located less than the first distance from the adapter flow aperture;

a curved section of the outer edge defined by the outer edge of the attachment body wherein the curved section is located radially outward from the adapter flow aperture;

a rear surface of the attachment body wherein the rear surface is located adjacent the bowl when the flange adapter attaches to the bowl;

a front surface of the attachment body located opposite of the rear surface wherein the first set of attachment apertures penetrate the front surface and the rear surface; and an attachment neck located radially inward of the first distance from the adapter flow aperture wherein the attachment neck extends longitudinally from the front surface of the attachment body, the second set of attachment apertures located on the attachment neck wherein the second set of attachment apertures terminate before reaching the rear surface;

a first seal base encompassing the adapter flow aperture on the rear surface of the attachment body, wherein the first seal base accepts a seal, the first seal base located adjacent the adapter flow aperture;

a second seal base encompassing the adapter flow aperture on the attachment neck of the front surface of the attachment body, wherein the second seal base accepts a seal, the second seal base located adjacent the adapter flow aperture;

said housing flow aperture extending longitudinally into the bowl;

an attachment finger extending longitudinally outward from the bowl wherein the attachment finger passes through one of the first set of attachment apertures when securing the attachment body to the bowl;

a housing seal base on the bowl located adjacent the housing flow aperture and located radially inward from the attachment finger towards the housing flow aperture wherein the attachment of the attachment body to the bowl aligns the first seal base with the housing seal base; and an adapter alignment indicator located on the front surface of the attachment body, the adapter alignment indicator distinct from the first set of attachment apertures and the second set of attachment apertures, the adapter alignment indicator located radially outward from the attachment neck, wherein alignment of the adapter alignment indicator with the bowl alignment indicator orients the flattened section of the attachment body to be installed as a lowest surface of the attachment body secured to the bowl for the fluids to flow horizontally through the adapter flow aperture to the flowline.

19. The apparatus of claim 18 wherein the outer edge of the attachment body forms a truncated circle wherein the flattened section defines the lowest surface of the attachment body when secured to the bowl.

20. The apparatus of claim 18 wherein the first seal base has a larger diameter than the second seal base.

* * * * *